United States Patent [19]

Akiyama et al.

[11] Patent Number: 4,839,963

[45] Date of Patent: Jun. 20, 1989

[54] SLIDER HANDLING APPARATUS

[75] Inventors: Hideki Akiyama; Toyoo Morita, both of Toyama, Japan

[73] Assignee: Yoshida Kogyo K. K., Tokyo, Japan

[21] Appl. No.: 227,636

[22] Filed: Aug. 3, 1988

[30] Foreign Application Priority Data

Aug. 7, 1987 [JP] Japan ..... 62-121275[U]

[51] Int. Cl.[4] ..... A41H 37/06; B21D 53/54

[52] U.S. Cl. ..... 29/766; 29/768; 29/409; 29/408; 29/33.2

[58] Field of Search ..... 29/409, 408, 768, 766, 29/33.2

[56] References Cited

U.S. PATENT DOCUMENTS

| | | | |
|---|---|---|---|
| 4,494,293 | 1/1985 | Kawakami | 29/408 |
| 4,520,544 | 6/1985 | Morita et al. | 29/408 |
| 4,598,454 | 7/1986 | Yunoki | 29/768 |
| 4,756,079 | 7/1988 | Kando | 29/409 |

FOREIGN PATENT DOCUMENTS

| | | |
|---|---|---|
| 0083113 | 12/1982 | European Pat. Off. . |
| 0083113 | 6/1983 | European Pat. Off. . |
| 0109643 | 3/1984 | European Pat. Off. . |
| 0193954 | 6/1986 | European Pat. Off. . |
| 0242213 | 4/1987 | European Pat. Off. . |
| 54-041940 | 12/1979 | Japan . |
| 59-103608 | 6/1984 | Japan . |

*Primary Examiner*—P. W. Echols
*Assistant Examiner*—Kevin Jordan

[57] ABSTRACT

A slider handling apparatus has a pressure roller and a drive roller peripherally engageable therewith to transfer a slide fastener chain assembled with component parts including sliders. A slider arresting means is operatively associated with the pressure and drive rollers for arresting sliders one at a time on the fastener chain at a predetermined point on the path of travel of the chain, the predetermined point being upstream of or in advance to the nip of the two rollers.

3 Claims, 6 Drawing Sheets

SLIDER HANDLING APPARATUS

BACKGROUND OF THE INVENTION

1. Field of the Invention:

This invention relates to an apparatus for handling sliders on a slide fastener chain and more particularly to such as a slider handling apparatus which is designed to arrest sliders one at a time and release the slider upon arrival at a predetermined point on the fastener chain.

2. Prior Art:

There are known numerous devices associated with a slide fastener assembling apparatus for holding a slider in place during movement of a fastener chain to couple opposed rows of fastener elements together prior to severing the chain to individual fastener lengths. One such device is disclosed in Japanese Laid-Open Patent Publication No. 59-103608 in which there are provided two pairs of transfer rolls, one pair of which designated at A in FIG. 8 of the accompanying drawings is provided with tiltable plate members C for releasably holding sliders one at a time mounted on a slide fastener chain F, while the other pair of transfer rolls B is adapted to move the chain until the slider held by the plate members C is brought into abutting engagement with the end stop member on the fastener chain F. The transfer rolls B are driven with a force greater than the tension of springs D associated with the plate members C, so that the plate members C are urged to rotate in the direction of transfer of the chain F thereby permitting the threading of the slider through the plate members C during the forward movement of the chain F.

The above prior art apparatus has a drawback in that as it involves two separate pairs of transfer rolls, the apparatus comes so much complicated and further in that the slider is brought all the way back to the terminal end of the coupling element rows and hence cannot be adjusted in position or posture at a desired intermediate point in advance of the end stop portion of the chain.

SUMMARY OF THE INVENTION

It is therefore the primary object of the present invention to provide a slider handling apparatus which is simple in construction and reliable in operation and which is designed to arrest sliders one at a time and release the slider upon arrival at a predetermined point on a slide fastener chain.

According to the invention, there is provided a slider handling apparatus which comprises: a pressure roller having a peripheral groove and vertically movable toward and away from the path of travel of a slide fastener chain carrying sliders thereon; a drive roller having a peripheral groove and engageable with said pressure roller across the fastener chain; and a slider arresting means comprising (a) an upper stopper received in the peripheral groove in said pressure roller and vertically movable therewith and (b) a lower stopper received in the peripheral groove in said drive roller and pivotally connected to a bracket member to move into and out of the path of the fastener chain; said upper and lower stopper cooperating in arresting sliders one at a time at a position in advance of the nip of said pressure and drive rollers.

The above and other objects and features of the invention will be better understood from the following description taken in conjunction with the accompanying drawings in which like reference numerals refer to like or corresponding parts throughout the several views.

DETAILED DESCRIPTION

Figure 1:
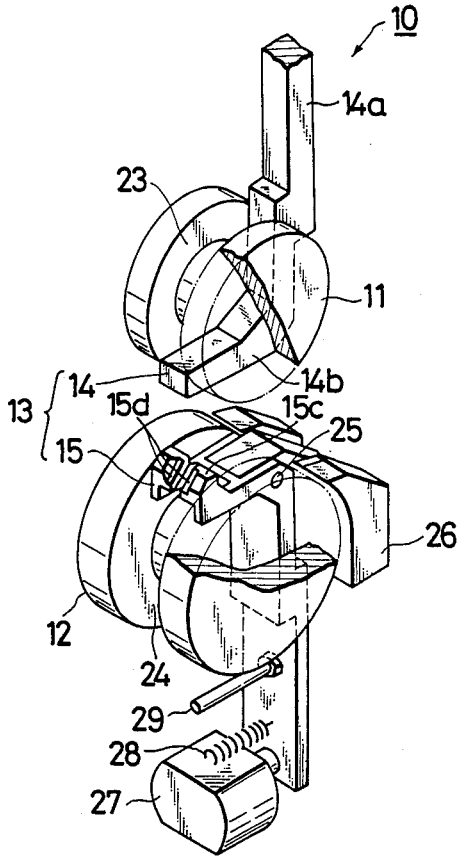
FIG. 1 is a perspective view of an essential part of the apparatus of the invention.

Referring now to the accompanying drawings and FIG. 1 in particular, there is shown a slider handling apparatus 10 which essentially comprises a pressure roller 11 and a drive roller 12 which are brought into peripheral engagement with each other by means hereafter described to feed or transfer a slide fastener chain F, and a slider arresting means 13 comprising an upper stopper 14 and a lower stopper 15 associated with the pressure roller 11 and the drive roller 12, respectively.

Figure 2:
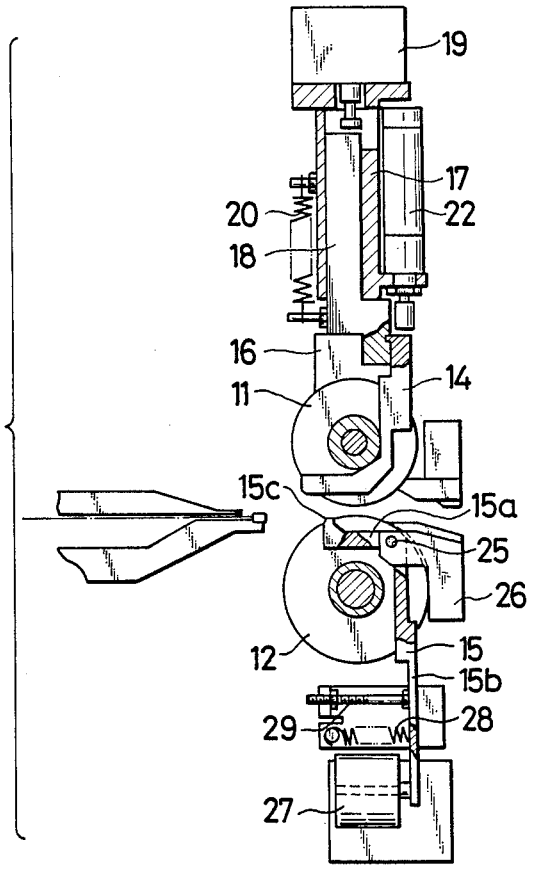
FIG. 2 is a side elevational view of the same.

As shown in FIG. 2, the prssure roller 11 is rotatably journalled in and connected to a roller holder 16 movably supported on a frame 17. The roller holder 16 is moved downwardly together with the pressure roller 11 by a sliding rod 18 connected to a jig cylinder 19 and moved upwardly back to its original position by the action of a tension spring 20. The pressure roller 11 is thus movable toward and away from the path of travel of the fastener chain F and engageable thereacross with the drive roller 12.

Figure 3:
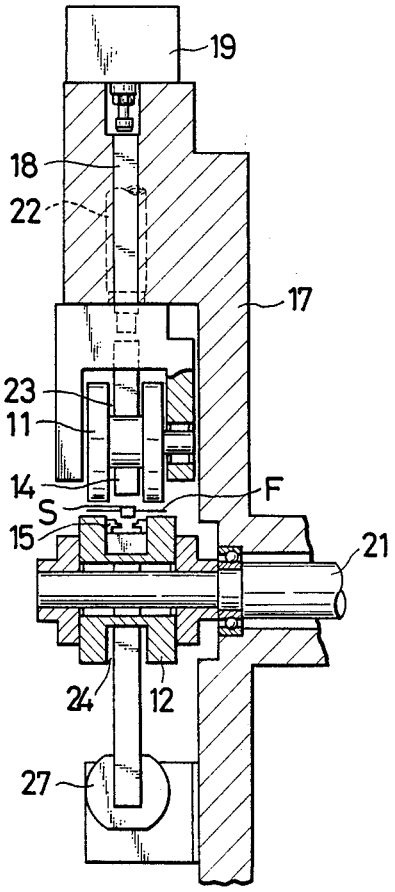
FIG. 3 is a front elevational view of the same.

As shown in FIG. 3, the drive roller 12 is axially connected to and driven by a horizontally extending drive shaft 21 connected to a drive source not shown.

The upper stopper 14 of the slider arresting means 13 is generally L-shaped and has a vertical arm **14*a* engageable with an air cylinder 22 (FIG. 2) and a horizontal arm 14*b* received in a peripheral groove 23 in the pressure roller 11 as shown in FIG. 1. The upper stopper 14 is connected to the roller holder 16 and vertically movable together with the pressure roller 11**.

However, when the jig cylinder 19 is operated to allow the pressure roller 11 to move upwardly apart from the drive roller 12 under the force of the tension spring 20 to release the slide fastener chain F for cutting individual product lengths therefrom, the air cylinder 22 is operated to extend its piston rod to limit the upward movement of the pressure roller 11 and the upper stopper 14 to such an extent that the upper stopper 14 is arranged to retain its operative position in which the slider S is held by and between the upper and lower stoppers 14, 15.

Figure 5:
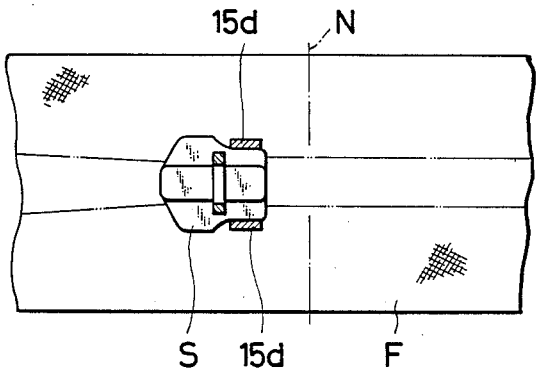
FIG. 5 is a bottom view of a portion of a slide fastener chain, indicating the position for arresting the slider.

The lower stopper 15 of the slider arresting means 13 has its major portion received in a peripheral groove 24 in the drive roller 12 and includes a relatively short horizontal arm **15*a* and a relatively long vertical arm 15*b*. The lower stopper 15 is pivotally connected at the junction of the two arms 15***a*, 15*b* to a pin 25 secured to a bracket member 26 to move into and out of the path of the chain F. The horizontal arm 15*a* has a rise portion 15*c* which is bifurcated as shown in FIG. 1 to provide a pair of confronting lugs 15*d* for gripping therebetween a slider body S as better shown in FIG. 5. The vertical arm 15*b* is connected at its lower end to and actuated by a jig cylinder 27 to rotate the lower stopper 15 counterclockwise so as to disengage the lugs 15*d* from the slider S and is also connected to a tension spring 28 which normally biases the lower stopper 15 clockwise. Designated at 29 is a limiter which is adapted to retain the lugs 15*d* in selected operative position and which is threaded to be able to adjust its operative length relative to the lower stopper 15.

Figure 4:
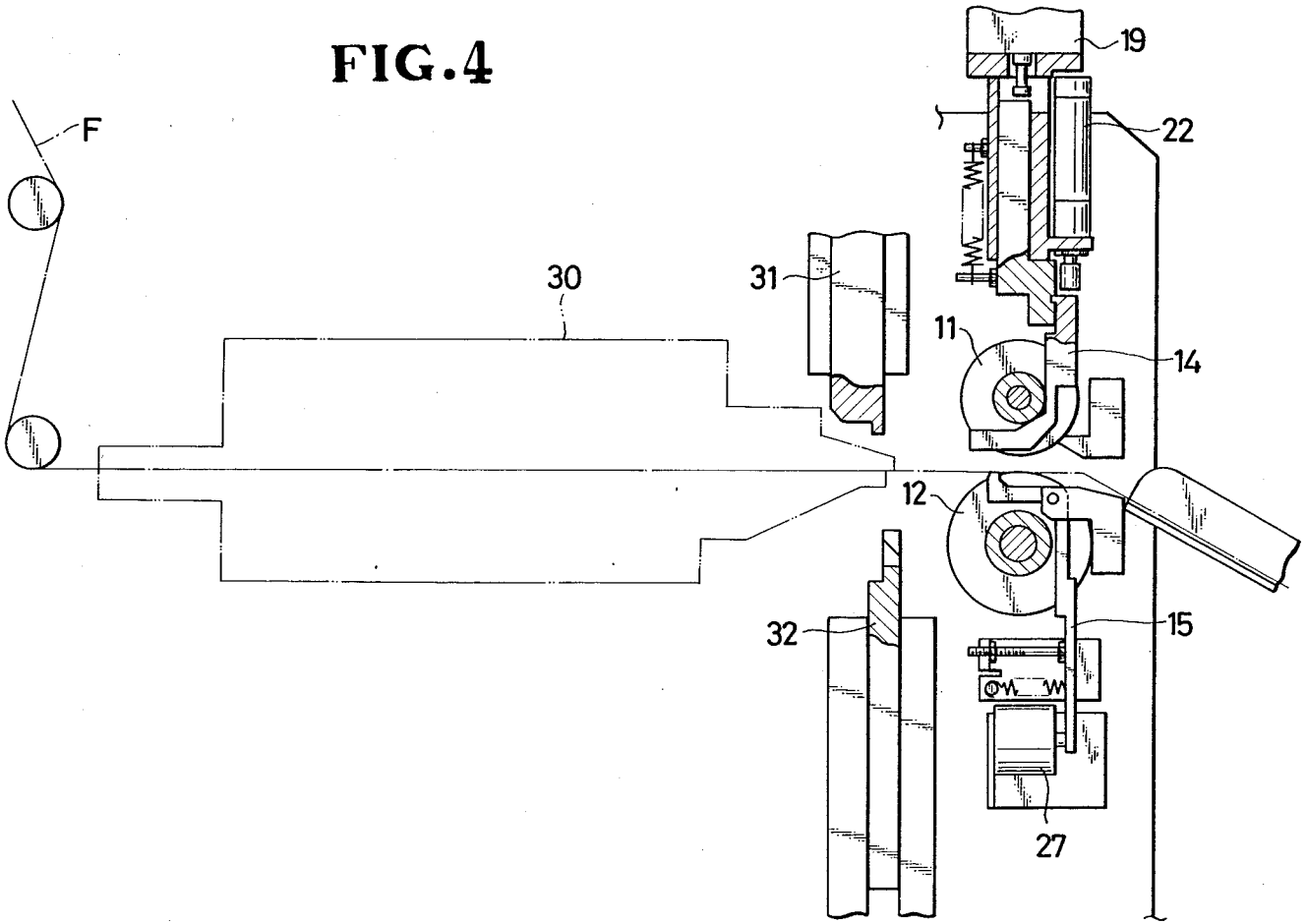
FIG. 4 is a side elevational view, partly schematic, of a general apparatus layout associated with the apparatus of the invention, utilized to explain the flow of an assembled slide fastener chain.

In operation of the apparatus 10 of the foregoing construction, the upper and lower stoppers 14, 15 of the slider arresting means 13 are held initially in their respective positions indicated by solid line (FIG. 6) until the slider S on an individual fastener length of a continuous elongate fastener chain F arrives at and is arrested by the slider arresting means. The slide fastener chain F is assembled with component parts including for example a reinforcing strip, a pin-and-box separator, a top end stop and a slider all on each of individual fastener product lengths as shown in FIG. 7. The fastener chain F is fed or transferred through a position control unit 30 and passed between and gripped by the pressure roller 11 and the drive roller 12 as illustrated in the general equipment layout of FIG. 4. The feeding or forward movement of the fastener chain F continues until the slider S reaches the slider arresting means 13 when the parallel side flange portions of the slider S engage in between the confronting lugs 15*d* of the lower stopper 15 as better shown in FIG. 5. While the slider S is thus arrested, the fastener chain F still continues to move between the rollers 11 and 12 so that the rows of fastener elements E become coupled together upon passage through the slider S which has been held stationary. As the fastener chain F arrives at a predetermined point on the path of its travel, the control unit 30 sends a signal to discontinue the travel of the chain F, when the pressure roller 11 ascends and releases the chain F from the drive roller 12.

In this instance, however, the upward movement of the pressure roller 11 and the upper stopper 14 is limited by the air cylinder 22 in such a manner that the upper stopper 14 remains in engagement with the slider S as previously described.

Figure 6:
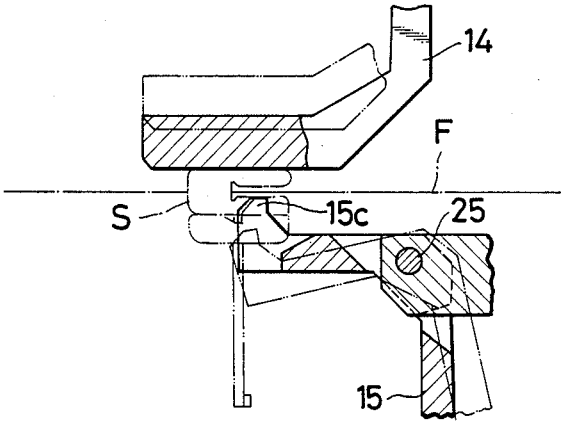
FIG. 6 is a schematic side elevational view illustrating the manner in which the slider is arrested and released.
Figure 7:
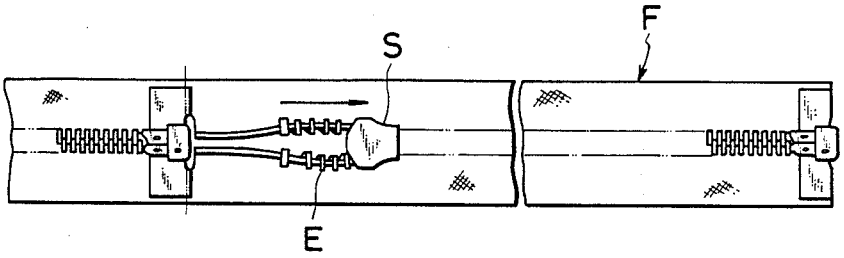
FIG. 7 is a plan view of a portion of an elongate slide fastener chain.
Figure 8:
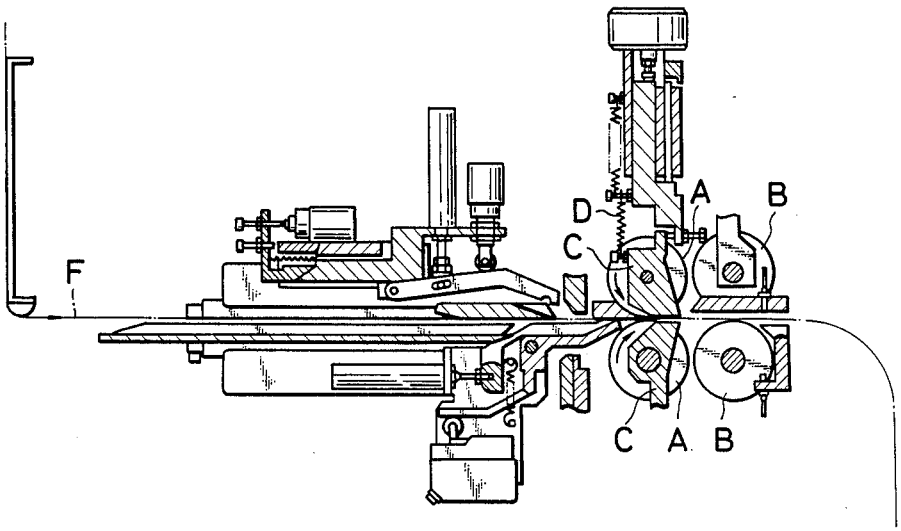
FIG. 8 PRIOR ART
FIG. 8 is a side elevational view of a prior art apparatus.

The chain F is then severed by coacting cutters 31, 32 located upstream of the slider handling apparatus 10, whereupon the pressure roller 11 descends and grips the chain F against the driven roller 12 to further move the chain F, in which instance the lower stopper 15 is rotated counterclockwise by actuation of the cylinder 27 so that the lugs 15*d* are retracted apart from the slider S as shown by phantom lines in FIG. 6. In this manner, the individual slide fastener which has been severed from the chain F is moved out of the apparatus 10 for inventory.

Since the slider S is arrested according to the invention at a position upstream or in advance of the nip N of the two rollers 11, 12; namely, in such a position where the chain F is freely movable, it is possible to arrest the slider S properly even when it is somewhat misaligned on the chain F.

The timing for actuation of the cylinder 27 can be adjusted so as to change the position of the slider S to be released from the arresting means 13 as desired.

Obviously, various modifications and variations of the present invention are possible in the light of the above teaching. It is therefore to be understood that within the scope of the appended claims the invention may be practiced otherwise than as specifically described.

What is claimed is:

1. A slider handling apparatus which comprises:

(i) a pressure roller having a peripheral groove and vertically movable toward and away from a path of travel of a slide fastener chain carrying sliders thereon;

(ii) a drive roller having a peripheral groove and engageable with said pressure roller across the fastener chain; and (iii) a slider arresting means comprising (iii-1) an upper stopper received in the peripheral groove in said pressure roller and vertically movable with said pressure roller; and (iii-2) a lower stopper received in the peripheral groove in said driver roller and pivotally connected to a bracket member to move into and out of the path of the fastener chain; said upper and lower stoppers cooperating in arresting sliders one at a time at a position in advance of a nip of said pressure and drive rollers.

2. A slider handling apparatus according to claim 1, further comprising a means for limiting upward movement of said upper roller and said upper stopper such that said upper stopper is retained in operative position when said pressure roller is lifted.

3. A slider handling apparatus according to claim 1 wherein said lower stopper has a horizontal arm, and a vertical arm, and a rise portion which is bifurcated to provide a pair of confronting lugs for gripping therebetween a slider.

* * * * *